US006389713B1

(12) United States Patent
Kita

(10) Patent No.: US 6,389,713 B1
(45) Date of Patent: May 21, 2002

(54) ATHLETIC SHOE MIDSOLE DESIGN AND CONSTRUCTION

(75) Inventor: Kenjiro Kita, Osaka (JP)

(73) Assignee: Mizuno Corporation, Osaka (JP)

( * ) Notice: Subject to any disclaimer, the term of this patent is extended or adjusted under 35 U.S.C. 154(b) by 0 days.

(21) Appl. No.: 09/395,516

(22) Filed: Sep. 14, 1999

(30) Foreign Application Priority Data

Oct. 2, 1998 (JP) ..... 10-296141

(51) Int. Cl.[7] ..... A93B 13/12

(52) U.S. Cl. ..... 36/30 R; 36/28; 36/31; 36/32 R

(58) Field of Search ..... 36/30 R, 44, 102, 36/114, 88, 92, 87, 76 C, 103, 25 R, 28, 29, 31, 32 R, 35 R, 37

(56) References Cited

U.S. PATENT DOCUMENTS

| | | | | |
|---|---|---|---|---|
| 2,364,134 A | | 12/1944 | Dow et al. | |
| 4,128,950 A | | 12/1978 | Bowerman et al. | |
| 4,399,620 A | | 8/1983 | Funck | |
| 4,561,195 A | | 12/1985 | Onoda et al. | |
| 4,774,774 A | | 10/1988 | Allen, Jr. | |
| 4,798,010 A | | 1/1989 | Sugiyama | |
| 4,805,319 A | | 2/1989 | Tonkel | |
| 4,864,737 A | | 9/1989 | Marrello | |
| 4,910,882 A | | 3/1990 | Goeller | |
| 4,930,232 A | | 6/1990 | Engle | |
| 4,999,931 A | | 3/1991 | Vermeulen | |
| 5,185,943 A | | 2/1993 | Tong et al. | |
| 5,720,118 A | | 2/1998 | Mayer et al. | |
| 5,974,695 A | * | 11/1999 | Slepian et al. | 36/27 |

FOREIGN PATENT DOCUMENTS

| | | |
|---|---|---|
| DE | 19641866 | 12/1997 |
| EP | 0092366 | 10/1983 |
| EP | 0857434 | 8/1998 |
| EP | 0878142 | 11/1998 |
| GB | 2032760 | 5/1980 |
| GB | 2114869 | 9/1983 |
| JP | 61-6804 | 3/1986 |
| WO | WO/90 06699 | 6/1990 |

* cited by examiner

*Primary Examiner*—Mickey Yu
*Assistant Examiner*—Jila Mohandesi
(74) *Attorney, Agent, or Firm*—W. F. Fasse; W. G. Fasse

(57) ABSTRACT

A midsole assembly for an athletic shoe includes a midsole formed of soft elastic material and a corrugated sheet disposed in a heel portion to a forefoot portion of the midsole. The upper midsole has a different hardness than the lower midsole. When the upper midsole has a lower hardness than the lower midsole, foot contact feeling and cushioning properties can be improved. On the other hand, when the lower midsole has a lower hardness than the upper midsole, shock load on landing is relieved and the cushioning properties can be improved. Moreover, in this case, when the load from the sole of a foot is applied to the upper midsole having a relatively high hardness, the corrugated sheet functions in such a way that the lateral deformation of the upper midsole can be prevented and running stability can be secured.

18 Claims, 16 Drawing Sheets

ATHLETIC SHOE MIDSOLE DESIGN AND CONSTRUCTION

CROSS-REFERENCE TO RELATED APPLICATIONS

This application relates to U.S. applications: Ser. No. 09/314,366, filed May 19, 1999; now U.S. Pat. No. 6,219,940 Ser. No. 09/318,578, filed May 25, 1999; now U.S. Pat. No. 6,705,681 Ser. No. 09/339,269, filed on Jun. 23, 1999; now U.S. Pat. No. 6,311,414. and Ser. No. 09/437,918, filed on Nov. 10, 1999 now patent No. 6,314,664.

BACKGROUND OF THE INVENTION

The present invention relates to an athletic shoe midsole design and construction. More particularly, the invention relates to a midsole assembly where there are provided a midsole formed of soft elastic material and a corrugated sheet disposed in the midsole.

The sole of an athletic shoe used in various sports is generally comprised of a midsole and an outsole fitted under the midsole, directly contacting with the ground. The midsole is typically formed of soft elastic material in order to ensure adequate cushioning properties.

Running stability as well as adequate cushioning properties are required in athletic shoes. There is a need to prevent shoes from being deformed excessively in the lateral or transverse direction when contacting with the ground.

As shown in Japanese Utility Model Application Publication No. 61-6804, the applicant of the present invention proposes a midsole assembly having a corrugated sheet therein, which can prevent such an excessive lateral deformation of shoes.

The midsole assembly shown in the above publication incorporates a corrugated sheet in a heel portion of a midsole and it can produce resistant force preventing the heel portion of a midsole from being deformed laterally or transversely when a shoe contacts with the ground. Thus, the transverse deformation of the heel portion of a shoe is prevented.

Generally, by inserting a corrugated sheet, compressive hardness (or hardness to deformation against the compressive force) of the whole midsole becomes high and the midsole tends to be less deformed in the vertical direction as well as transverse direction. Therefore, when the corrugated sheet is interposed in the midsole, the midsole portion where adequate cushioning properties is required may show less cushioning properties, or an athlete may have an unpleasant feeling around the sole of a foot in the shoes when the shoes come in contact with the ground.

On the other hand, a corrugated sheet is generally composed of a homogeneous material, but if the compressive hardness can be changed according to the regions of the corrugated sheet, detailed and delicate adjustments can be possible with regard to the contradictory requirements of preventing lateral deformation and achieving cushioning properties on landing.

The object of the present invention is to provide a midsole assembly for an athletic shoe that can secure not only running stability but also cushioning properties. Another object of the present invention is to provide a midsole assembly for an athletic shoe that can secure running stability and make foot sole contact feeling pleasant. A further object of the present invention is to provide a midsole assembly for an athletic shoe that can make detailed and delicate adjustments with regard to the contradictory requirements of preventing lateral deformation and achieving cushioning properties on landing.

SUMMARY OF THE INVENTION

The present invention provides a midsole assembly for an athletic shoe.

In one embodiment, a midsole assembly comprises a midsole formed of soft elastic material and a corrugated sheet disposed in the heel portion to the forefoot portion of the midsole. The midsole is composed of an upper midsole placed on the upper side of the corrugated sheet and a lower midsole placed on the lower side of the corrugated sheet. The upper midsole has a different hardness from that of the lower midsole.

A second embodiment provides a midsole assembly according to the first embodiment, wherein the upper and lower midsoles are comprised of the same material.

A third embodiment provides a midsole assembly according to the first embodiment, wherein the upper and lower midsoles are comprised of different materials.

A fourth embodiment provides a midsole assembly according to the first embodiment, wherein the heel portion of the upper midsole has a lower hardness than the heel portion of the lower midsole.

A fifth embodiment provides a midsole assembly according to the first embodiment, wherein the heel portion of the lower midsole has a lower hardness than the heel portion of the upper midsole.

A sixth embodiment provides a midsole assembly according to the first embodiment, wherein the forefoot portion of the upper midsole has a lower hardness than the forefoot portion of the lower midsole.

A seventh embodiment provides a midsole assembly according to the first embodiment, wherein the forefoot portion of the lower midsole has a lower hardness than the forefoot portion of the upper midsole.

An eighth embodiment provides a midsole assembly according to the first embodiment, wherein a higher elastic member than the corrugated sheet is provided along the outer circumference of the heel portion of the corrugated sheet.

A ninth embodiment provides a midsole assembly according to the first embodiment, wherein a lower elastic portion than the corrugated sheet is provided on the heel central region of the corrugated sheet.

A tenth embodiment provides a midsole assembly according to the first embodiment, wherein a higher elastic member than the corrugated sheet is provided along the outer circumference of the heel portion of the corrugated sheet. Also, a lower elastic portion than the corrugated sheet is provided on the heel central region of the corrugated sheet.

The higher elastic member may be comprised of a fiber-reinforced plastic sheet or a metal plate, as is respectively described in an eleventh or twelfth embodiment.

The higher elastic member may be bonded to the corrugated sheet, or may be injection molded with the corrugated sheet, as is respectively described in a thirteenth or fourteenth embodiment.

The lower elastic portion may be comprised of a plurality of holes formed in the corrugated sheet, as is described in a fifteenth embodiment. Alternatively, as is described in a sixteenth embodiment, the lower elastic portion may be comprised of a meshed sheet that is injection molded with the corrugated sheet.

A seventeenth embodiment provides a midsole assembly according to the first embodiment, wherein a lower elastic portion is provided at the forefoot portion of the corrugated sheet.

The lower elastic portion may be comprised of a plurality of holes formed in the corrugated sheet, as is described in an eighteenth embodiment. In the alternative, as is described in a nineteenth embodiment, the lower elastic portion may be comprised of a meshed sheet that is injection molded with the corrugated sheet.

The forefoot portion of the corrugated sheet may include a groove that extends in the transverse direction, as is described in a twentieth embodiment.

A twenty-first embodiment provides a midsole assembly according to the first embodiment, wherein a higher elastic member than the corrugated sheet is provided at the plantar arch portion of the corrugated sheet.

The higher elastic member may be comprised of a fiber-reinforced plastic sheet, or a metal plate, as is respectively described in a twenty-second or twenty-third embodiment.

The higher elastic member may be bonded to the corrugated sheet, as is described in a twenty-fourth embodiment. Alternatively, the higher elastic member may be injection molded with the corrugated sheet, as is described in a twenty-fifth embodiment.

A twenty-sixth embodiment provides a midsole assembly according to the first embodiment, wherein the amplitude of the wave configuration of the corrugated sheet is larger on the medial and lateral sides of the heel portion of the corrugated sheet, and smaller at the heel central portion.

A twenty-seventh embodiment provides a midsole assembly according to the first embodiment, wherein the phase of the wave configuration of the corrugated sheet is offset by one-half pitch between the medial and lateral sides of the heel portion of the corrugated sheet.

In the first embodiment, a corrugated sheet is disposed in the heel portion to the forefoot portion of the midsole.

Thus, the regions from the heel portion to the forefoot portion of the midsole tend to be less deformed in the lateral or transverse direction at the time of landing on the ground. As a result, the forefoot portion as well as the heel portion can be prevented from being laterally deformed and running stability can be secured.

Moreover, because the corrugated sheet is provided in the forefoot portion, the bending or turning direction of the forefoot portion can be controlled. That is, when the wavelength of the wave configuration of the corrugated sheet is different between the medial and lateral sides of the forefoot portion, the ridge lines of the wave configuration are disposed in a fan shape. Thus, when an athlete lands on the ground with the heel portion to the toe portion, weight transfer path or load path of the shoe sole can nearly coincide with the director line of the wave configuration of the corrugated sheet.

Thus, the heel portion flexibly deforms according to the weight transfer, and smooth weight transfer and stable grip properties can be secured with the cushioning properties and running stability maintained on the heel contact with the ground.

Furthermore, according to the first embodiment, hardness of the upper midsole disposed on the upper side of the corrugated sheet is different from the hardness of the lower midsole disposed on the lower side of the corrugated sheet. For example, when the hardness of the lower midsole is lowered, the cushioning properties are improved. On the other hand, when the hardness of the upper midsole is lowered, contact feeling of the foot sole of an athlete becomes better.

In addition, difference of the hardness of the upper and lower midsoles is preferably about 10 degrees at Asker C scale.

The upper midsole and lower midsole may be composed of the same material, as shown in the second embodiment. Alternatively, the upper and lower midsole may be composed of the different materials, as shown in the third embodiment.

When the upper midsole and lower midsole are made of the same material, in altering the hardness of the upper and lower midsoles, expansion ratios of the upper and lower midsoles are made different. That is, a higher expansion ratio decreases hardness, whereas a lower expansion ratio increases hardness.

Alternatively, by altering the characteristics of the material itself, hardness can be changed. That is, adding plasticizer in the material or altering the volume of adjunct of the plasticizer can be employed. Adding plasticizer lowers the hardness of the material and increasing the volume of adjunct of the plasticizer further lowers its hardness. Moreover, hardness can be changed by altering the degree of polymerization, and thus changing the molecular weight.

In addition, when the upper and lower midsoles are made of different materials, the hardness of the upper and lower midsoles can be altered by adopting the similar method mentioned above.

According to the fourth embodiment, because the hardness of the heel portion of the upper midsole is lower than that of the heel portion of the lower midsole, contact feeling of the heel portion of a shoes wearer is improved at the time of landing on the ground and the cushioning properties are advanced.

According to the fifth embodiment, because the hardness of the heel portion of the lower midsole is lower than that of the heel portion of the upper midsole, shock load from the contact surface with the ground to the heel portion at the time of landing is relieved at the lower midsole and cushioning properties of the heel portion are improved. On the other hand, since the upper midsole, which has a higher hardness than the lower midsole, is hard to be deformed and is thus relatively less deformed, the corrugated sheet generates a resistance force against the load applied to the upper midsole from the foot sole of a shoes wearer, and as a result, the heel portion is prevented from being deformed laterally or transversely after landing.

According to the sixth embodiment, because the hardness of the forefoot portion of the upper midsole is lower than that of the forefoot portion of the lower midsole, contact feeling of the forefoot portion of a shoes wearer at the time of landing becomes pleasant and cushioning properties are improved, and flexibility of the forefoot portion as well is improved.

According to the seventh embodiment, because the hardness of the forefoot portion of the lower midsole is lower than that of the forefoot portion of the upper midsole, cushioning properties are improved in such a way that shock load from the contact surface with the ground to the forefoot portion at the time of landing is relieved at the lower midsole. On the other hand, since the upper midsole tends to be relatively less deformed, the corrugated sheet develops its natural function against the load applied from the foot sole of a shoes wearer to the upper midsole and as a result, the forefoot portion can be prevented from being deformed in the transverse direction after landing.

According to the eighth embodiment, a higher elastic member is disposed along the outer circumference of the heel portion of the corrugated sheet. Here, "higher elastic" means having a higher modulus of elasticity.

Thus, the compressive hardness (or hardness to deformation against the compressive force) of the midsole is made higher at the outer circumference of the heel portion, and as a result, even in the athletics where severe lateral movements are included, deformation of a shoe after landing can be prevented and running stability can be secured. Moreover, in that the heel of a foot can be restrained from unnecessarily sinking into the midsole, loss of athletic power is lessened.

On the other hand, because flexibility of the midsole is maintained in some degree at the heel central portion, which has a relatively small compressive hardness compared to the heel outer circumferential portion, cushioning properties on landing can be ensured at this heel central portion.

In this way, two contradictory requirements of preventing lateral deformation and ensuring cushioning properties can be satisfied.

Additionally, in this case, when a material of relatively small elasticity as a corrugated sheet is used, the heel central portion of the midsole can be made more flexible and cushioning properties can be more improved.

Moreover, specifically, when the hardness of the heel portion of the lower midsole is lower than that of the heel portion of the upper midsole, lateral or transverse deformation of shoes after landing can be more securely prevented with less deformation of the upper midsole and running stability can be further improved.

According to the ninth embodiment, a lower elastic portion than the corrugated sheet is provided in the heel central portion of the corrugated sheet. Here, "lower elastic" means having a lower modulus of elasticity.

Thus, the compressive hardness of the midsole is lowered at the heel central portion, and as a result, flexibility of the midsole is maintained and cushioning properties on landing can be advanced.

On the other hand, at the outer circumferential region of the heel portion, which has a relatively high compressive hardness compared to the heel central portion, lateral deformation after landing can be prevented and running stability can be secured.

Consequently, in this case as well, similarly to the eighth embodiment, two contradictory requirements of prevention of transverse deformation and securement of cushioning properties can be satisfied at the heel portion.

In addition, specifically, when the hardness of the heel portion of the lower midsole is lower than that of the heel portion of the upper midsole, cushioning properties can be further improved with the cushioning performance of the lower midsole.

According to the tenth embodiment, a higher elastic member than the corrugated sheet is placed along the outer circumference of the heel portion of the corrugated sheet and a lower elastic portion than the corrugated sheet is provided at the heel central portion of the corrugated sheet.

Thus, lateral or transverse deformation after landing can be prevented at the heel outer circumferential portion having a greater compressive hardness, and cushioning properties on landing can be secured at the heel central portion having a smaller compressive hardness.

According to the eleventh embodiment, a higher elastic member is composed of a fiber-reinforced plastic sheet. This fiber-reinforced plastic (FRP) sheet comprises reinforcement fiber and matrix resin. Reinforcement fiber may be carbon fiber, aramid fiber, glass fiber or the like. Matrix resin may be thermoplastic or thermosetting resin. In this way, the corrugated sheet has improved elasticity and durability, and can bear a prolonged use.

A higher elastic member may be composed of a metal plate such as SUS (or stainless steel) plate, super elastic alloy plate or the like, as shown in the twelfth embodiment.

A higher elastic member may be bonded to the corrugated sheet, as shown in the thirteenth embodiment. In the alternative, as shown in the fourteenth embodiment, a higher elastic member may be injection molded together with the corrugated sheet.

A lower elastic portion may be comprised of a plurality of holes formed in the corrugated sheet, as shown in the fifteenth embodiment. Alternatively, as shown in the sixteenth embodiment, a lower elastic portion may be comprised of a meshed sheet that is injection molded together with the corrugated sheet.

According to the seventeenth embodiment, a lower elastic portion than the corrugated sheet is provided at the forefoot portion of the corrugated sheet.

Thus, the compressive hardness of the midsole is lowered at the forefoot portion, and as a result, cushioning properties of the forefoot portion can be secured at the time of landing. Moreover, flexibility of the forefoot portion can be improved and turnability of the forefoot portion can be advanced.

Furthermore, in this case, when the hardness of the forefoot portion of the upper midsole is lower than that of the forefoot portion of the lower midsole, flexibility of the forefoot portion can be further improved.

In addition, the forefoot portion of the corrugated sheet may be formed with a plurality of holes, which is formed in the corrugated sheet, as shown in the eighteenth embodiment. The forefoot portion of the corrugated sheet may be comprised of a meshed sheet that is injection molded together with the corrugated sheet, as shown in the nineteenth embodiment.

As shown in the twentieth embodiment, a groove extending in the lateral or transverse direction may be formed at the forefoot portion of the corrugated sheet. In this case, flexibility of the forefoot portion of the midsole can be further improved and control of turning or bending direction can be conducted with ease.

That is, when the spaces of the grooves at the forefoot portion are made different between the medial and lateral sides, grooves are disposed in a fan shape, thereby allowing the weight transfer path (or load path) at the shoe sole surface to nearly conform with the director line of the grooves.

Thus, the heel portion flexibly deforms according to the weight transfer with the cushioning properties and running stability maintained at the time of landing. As a result, smooth weight transfer and secure grip properties can be ensured.

According to the twenty-first embodiment, a higher elastic member than the corrugated sheet is disposed at the plantar arch portion of the corrugated sheet. Thus, so-called shank effect can be developed and rigidity of the plantar arch portion can be improved. As a result, after landing, lateral deformation of the plantar arch portion of the midsole can be prevented and running stability can be secured.

A higher elastic member may be composed of a fiber-reinforced plastic sheet, as shown in the twenty-second embodiment. Or a higher elastic member may be composed of a metal plate, as shown in the twenty-third embodiment.

A higher elastic member may be bonded to the corrugated sheet, as shown in the twenty-fourth embodiment. In alternative, as shown in the twenty-fifth embodiment, a higher elastic member may be injection molded together with the corrugated sheet.

According to the twenty-sixth embodiment, the amplitude of the wave configuration of the corrugated sheet is larger on the medial and lateral sides of the heel portion of the corrugated sheet, and smaller at the heel central portion.

Thus, flexibility of the midsole is maintained at the heel central portion having a small amplitude and the compressive hardness of the midsole is made greater on the medial and lateral sides having a large amplitude. As a result, cushioning properties on landing can be secured at the heel central portion, and lateral or transverse deformation of the heel portion after landing can be prevented and running stability can be improved.

In this manner, similarly to the eighth and ninth embodiments, two contradictory requirements of prevention of lateral deformation and securement of cushioning properties can be satisfied at the heel portion.

In this case, when the hardness of the heel portion of the upper midsole is lower than that of the heel portion of the lower midsole, cushioning properties can be advanced with foot contact feeling in the shoes on landing made pleasant.

On the contrary, when the hardness of the heel portion of the lower midsole is lower than that of the heel portion of the upper midsole, cushioning properties of the lower midsole can be further improved.

According to the twenty-seventh embodiment, phase of the wave configuration of the corrugated sheet is offset by one-half pitch between the medial and lateral sides of the heel portion of the corrugated sheet.

In this case, as regards the wave configuration of the heel medial side to the heel lateral side, the crest at the medial portion is positioned against the trough at the lateral portion. Similarly, the trough at the medial portion is positioned against the crest at the lateral portion.

Thus, the ridge line of the wave configuration at the heel medial portion gradually declines as it goes toward the heel central portion, and when the ridge line crosses the heel central portion, the amplitude of the wave configuration becomes zero. As the ridge line goes over the heel central portion, it becomes a trough line, and the trough line declines as it goes toward the heel lateral portion.

Similarly, the ridge line of the wave configuration at the heel lateral portion gradually declines as it goes toward the heel central portion, and when the ridge line crosses the heel central portion, the amplitude of the wave configuration becomes zero. As the ridge line goes over the heel central portion, it becomes a trough line, and the trough line declines as it goes toward the heel medial portion.

In this way, because the amplitude of the wave configuration is zero at the central portion between the heel medial and lateral sides, similarly to the twenty-sixth embodiment, flexibility of the midsole is maintained at the heel central portion and the compressive hardness of the midsole is made greater at the medial and lateral sides of the heel portion. As a result, cushioning properties on landing can be secured at the heel central portion, and transverse deformation after landing can be prevented at the heel medial and lateral sides, thereby improving the running stability.

In this case, when the hardness of the heel portion of the upper midsole is lower than that of the heel portion of the lower midsole, cushioning properties can be improved with foot contact feeling in shoes at the time of landing made pleasant.

On the contrary, when the hardness of the heel portion of the lower midsole is lower than that of the heel portion of the upper midsole, cushioning properties of the lower midsole can be further improved.

BRIEF DESCRIPTION OF THE DRAWINGS

For a more complete understanding of the invention, reference should be made to the embodiments illustrated in greater detail in the accompanying drawings and described below by way of examples of the invention. In the drawings, which are not to scale.

DETAILED DESCRIPTION OF THE PREFERRED EMBODIMENTS

Figure 1:
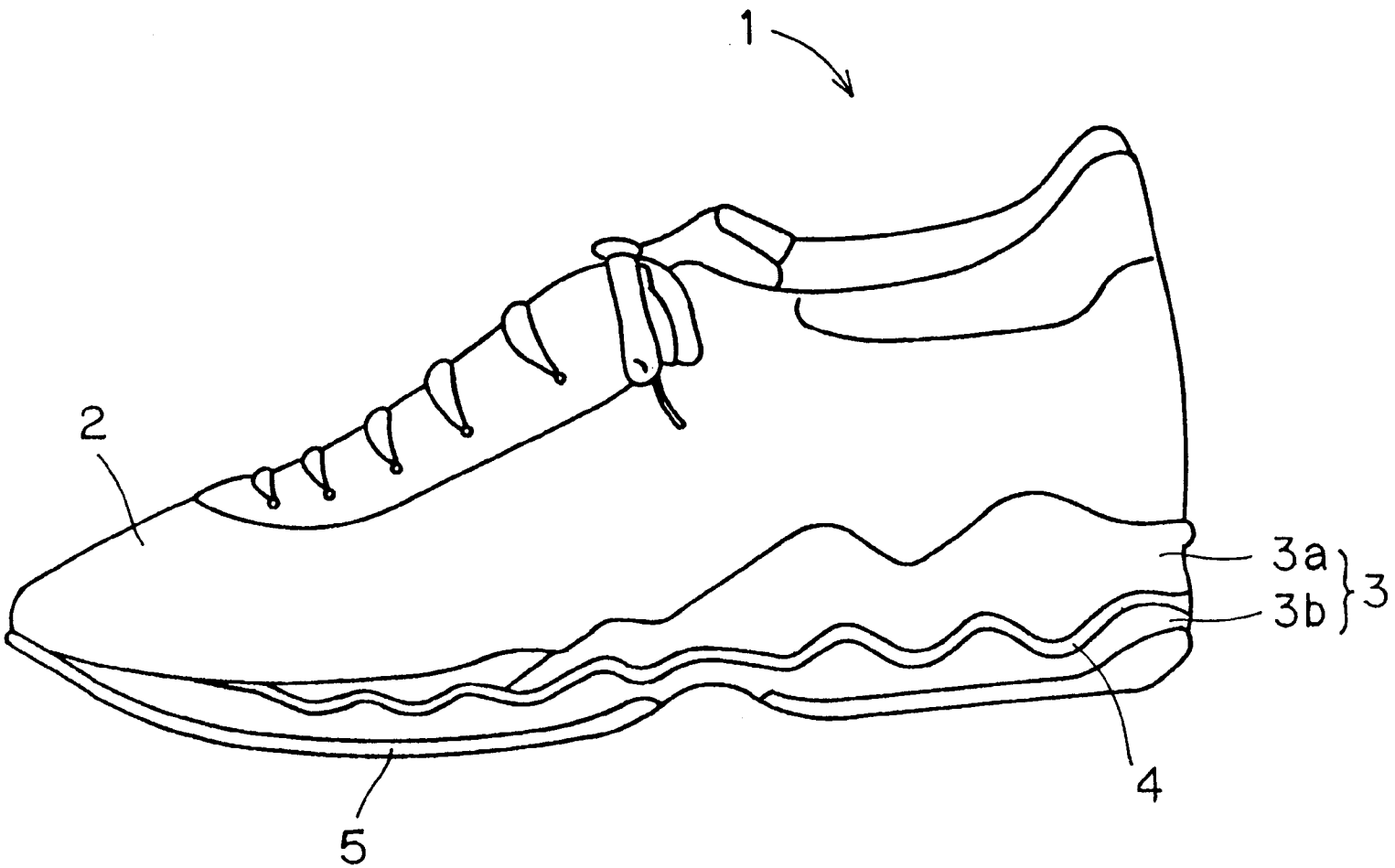
FIG. 1 is a side view of an athletic shoe incorporating the midsole construction of the present invention.

Turning now to the drawings, FIG. 1 illustrates an athletic shoe incorporating a midsole construction of the present invention. The sole of this athletic shoe 1 comprises a midsole 3, a corrugated sheet 4 and an outsole 5 directly contacting with the ground. The midsole 3 is fitted to the bottom of uppers 2. The corrugated sheet 4 is disposed in the midsole 3 and includes a wave configuration. The outsole 5 is fitted to the bottom of the midsole 3.

The midsole 3 is provided in order to absorb a shock load imparted on the heel portion of the shoe 1 when an athlete lands on the ground. The midsole 3 is comprised of an upper midsole 3*a* and a lower midsole 3*b* which are respectively disposed on the top and bottom surfaces of the corrugated sheet 4. The corrugated sheet 4 extends from the heel portion to the forefoot portion of the midsole 3.

Figure 2:
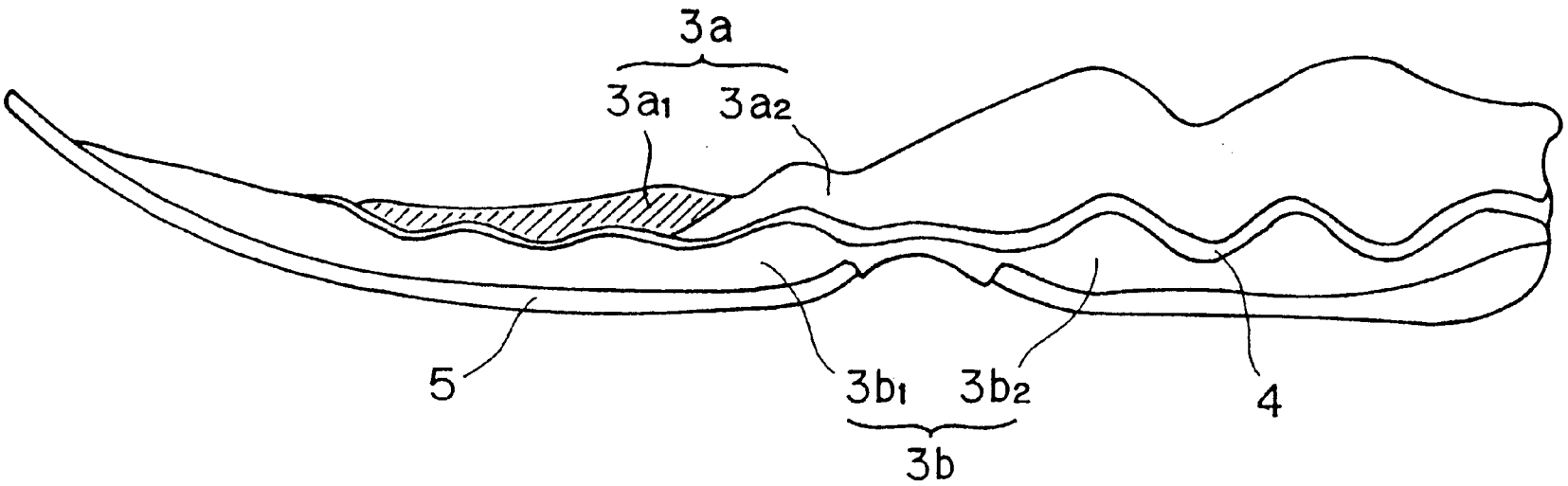
FIG. 2 is a side view of the midsole construction according to one embodiment of the present invention.
Figure 3:
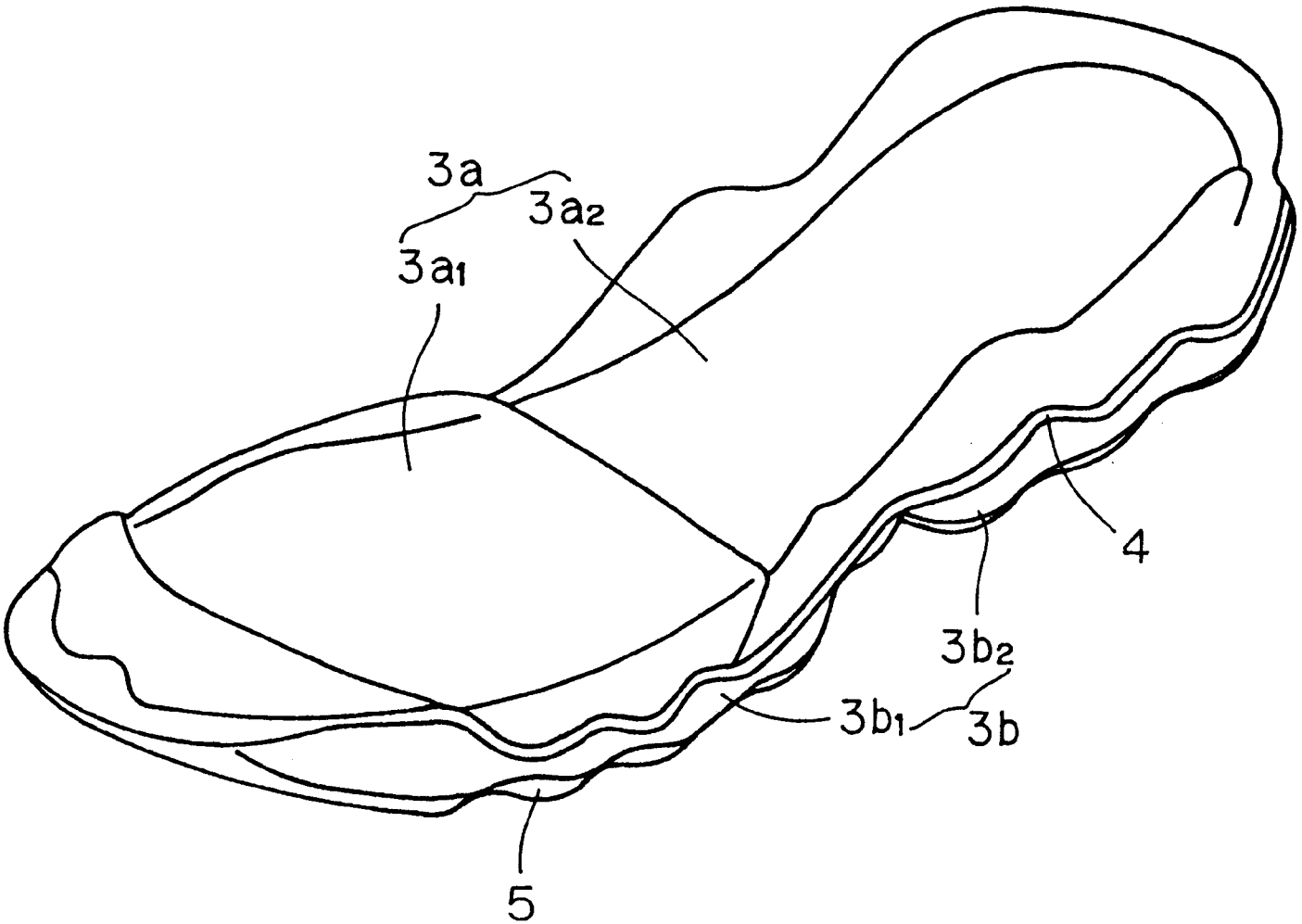
FIG. 3 is a perspective view of the midsole construction of one embodiment of the present invention.

As shown in FIGS. 2 and 3, the upper midsole 3*a* is comprised of an upper forefoot portion $\mathbf{3}a_1$ disposed at the forefoot portion and an upper heel portion $3a_2$ disposed at the heel portion to the plantar arch portion. Similarly, the lower midsole 3*b* is comprised of a lower forefoot portion $3b_1$ disposed at the forefoot portion and a lower heel portion $3b_2$ disposed at the heel portion to the plantar arch portion.

The midsole 3 is generally formed of soft elastic material having good cushioning properties. Specifically, thermoplastic synthetic resin foam such as ethylene-vinyl acetate copolymer (EVA), thermosetting resin foam such as polyurethane (PU), or rubber material foam such as butadiene or chloroprene rubber is used.

Figure 4:
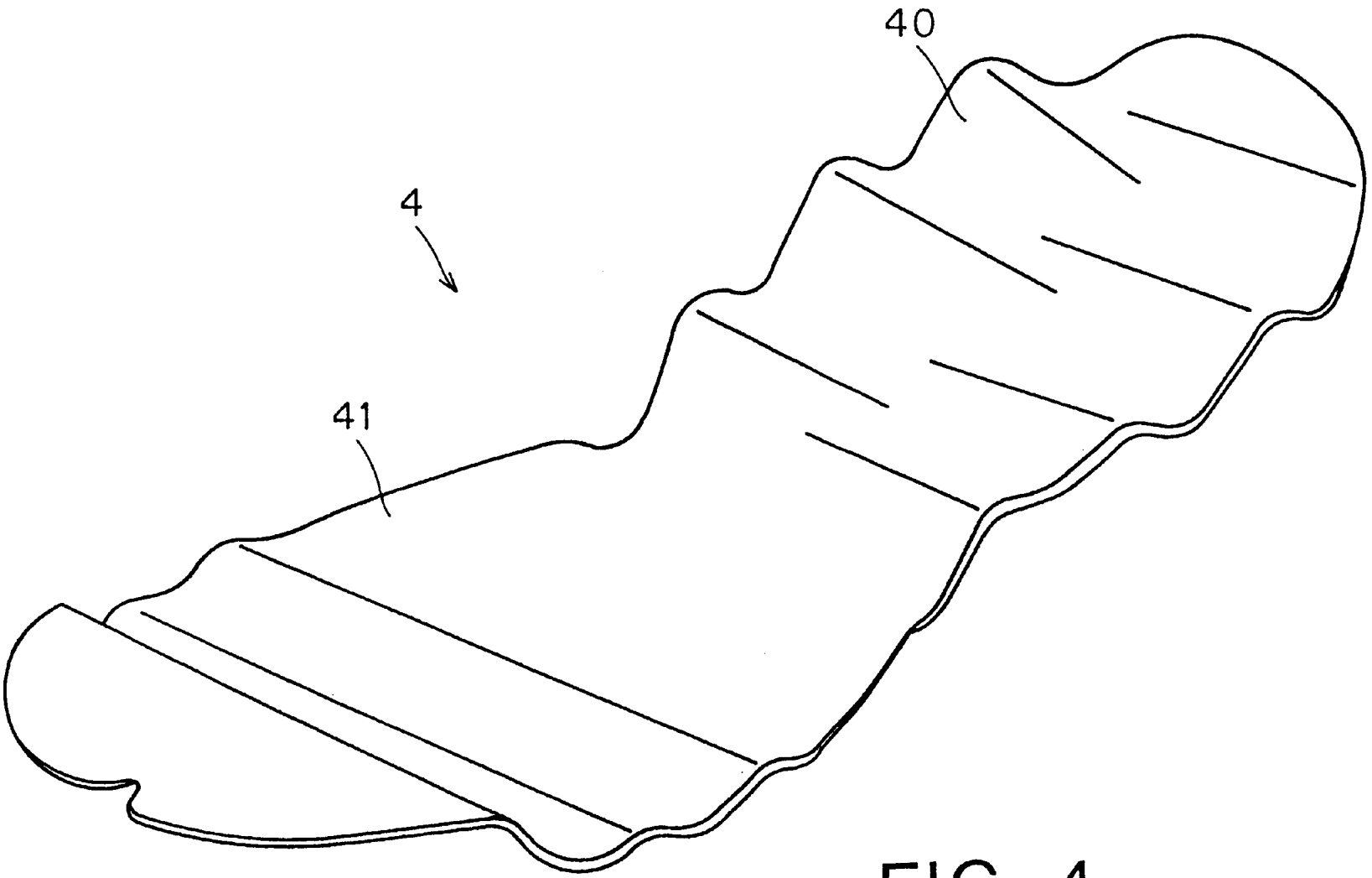
FIG. 4 is a perspective view of the corrugated sheet of th midsole construction.

As shown in FIG. 4, the corrugated sheet 4 comprises a heel portion 40 extending to the plantar arch portion and a forefoot portion 41. The corrugated sheet 4 is formed of thermoplastic resin such as thermoplastic polyurethane (TPU) of comparatively rich elasticity, polyamide elastomer (PAE), ABS resin or the like. Alternatively, the corrugated sheet 4 is formed of thermosetting resin such as epoxy resin, unsaturated polyester resin or the like. In addition, the corrugated sheet 4 may be formed of a woven fabric, knitted cloth, non-woven fabric, or soft sheet such as vinyl sheet.

Figure 5:
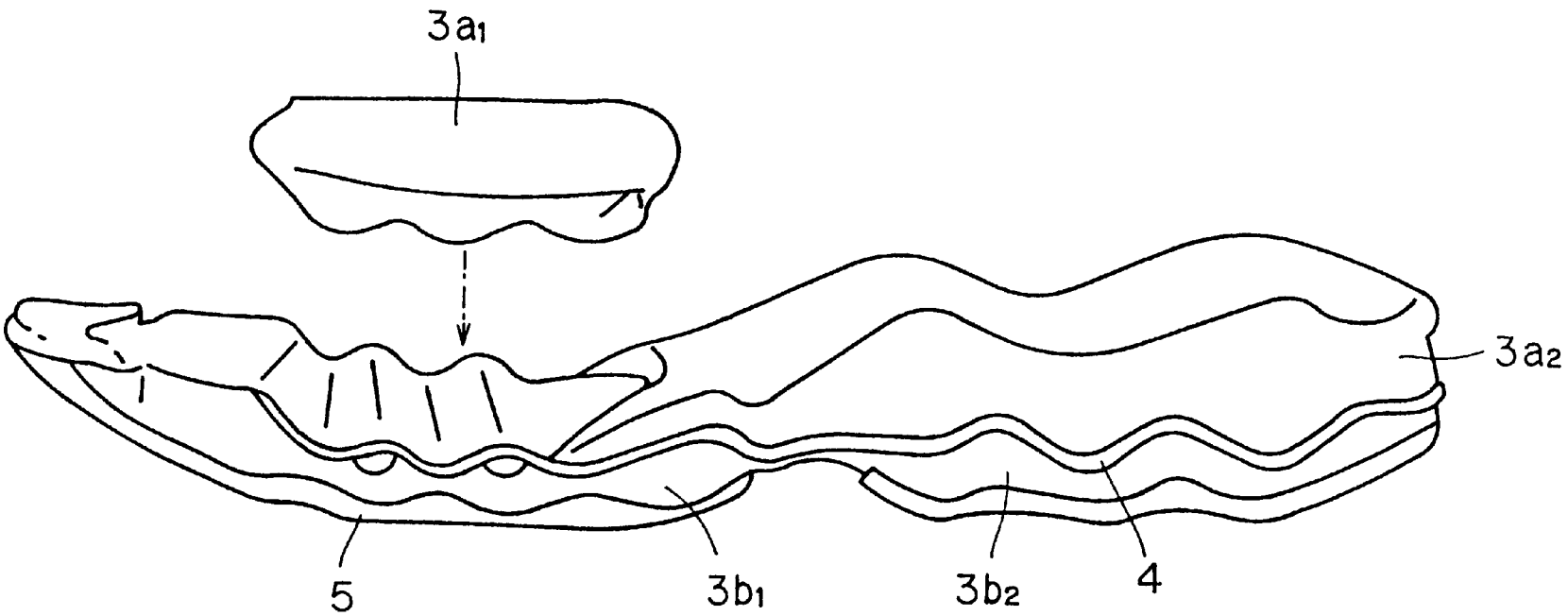
FIG. 5 is a partially exploded view of the midsole construction.

FIG. 2 is a side view of the midsole construction of the first embodiment of the present invention. FIG. 5 is a partially exploded view of the midsole construction of FIG. 2. As shown in FIGS. 2 and 5, the corrugated sheet 4 extends from the heel portion to the forefoot portion of the midsole construction. Thus, at the time of landing of a shoe, the regions from the heel portion to the forefoot portion of the midsole tend to be less deformed. As a result, lateral or transverse deformation of the forefoot portion as well as heel portion can be prevented and running stability can be ensured.

Moreover, in that the corrugated sheet 4 is interposed at the forefoot portion, bending or turning direction of the forefoot portion can be controlled. That is, when the wavelength of the wave configuration of the corrugated sheet 4 is made different between the medial and lateral sides of the forefoot portion, the ridge lines of the wave configuration are positioned in a fan shape, and thus, weight transfer path (or load path) of the shoe sole can nearly coincide with the director line of the wave configuration of the corrugated sheet 4 when an athlete lands on the ground from the heel portion to the toe portion of shoes.

Thus, with the cushioning properties and running stability on landing maintained, the heel portion flexibly deforms according to the weight transfer, thereby ensuring smooth weight transfer and secure grip properties.

Furthermore, hardness of the upper forefoot portion $3a_1$ (see hatching portion of FIG. 2) of the upper midsole 3*a* is lower than that of the lower forefoot portion $3b_1$ of the lower midsole 3*b*. Thus, at the time of landing, contact feeling of the forefoot portion of a shoes wearer can be made pleasant, cushioning properties can be improved and flexibility of the forefoot portion can be advanced. The athletic shoes of this embodiment are suitable for shoes such as walking shoes.

Hardness of the upper forefoot portion $3a_1$ of the upper midsole 3*a* is preferably 30–60 degrees at C scale of Asker hardness. Hardness of the lower forefoot portion 3*b*, of the lower midsole 3*b* is preferably 40–70 degrees at C scale of Asker hardness. And difference of hardness between the upper forefoot portion $3a_1$ and the lower forefoot portion $3b_1$ is preferably about 10 degrees at C scale of Asker hardness.

In a preferred embodiment, hardness of the upper forefoot portion $3a_1$ of the upper midsole 3*a* is set at about 45 degrees and hardness of the lower forefoot portion $3b_1$ of the lower midsole 3*b* is set at about 55 degrees. On the other hand, when synthetic resin having comparatively rich elasticity is used as a corrugated sheet 4, hardness of the corrugated sheet 4 is preferably set at 55–60 degrees at D scale of Asker hardness.

The procedure to alter the hardness of the upper forefoot portion $3a_1$ and the lower forefoot portion $3b_1$ is to make each expansion ratio of the upper and lower forefoot portions $3a_1$ and $3b_1$ different by using the same material. That is, high expansion ratio decreases hardness, whereas low expansion ratio increases hardness.

Alternatively, hardness can be changed by altering the characteristics of the material itself. That is, adjunction of plasticizer into the material or alteration of the volume of plasticizer adjunct may be adopted. Adding plasticizer lowers hardness and increasing the volume of the plasticizer adjunct lowers hardness further. Moreover, hardness can be changed by altering the degree of polymerization, and thus molecular weight.

In addition, the upper forefoot portion $3a_1$ of the upper midsole 3*a* and the lower forefoot portion $3b_1$ of the lower midsole 3*b* may be formed of different materials. In this case, when altering hardness of the upper and lower forefoot portions $3a_1$ and $3b_1$, the above-mentioned methods can be employed in the same manner.

Figure 6:
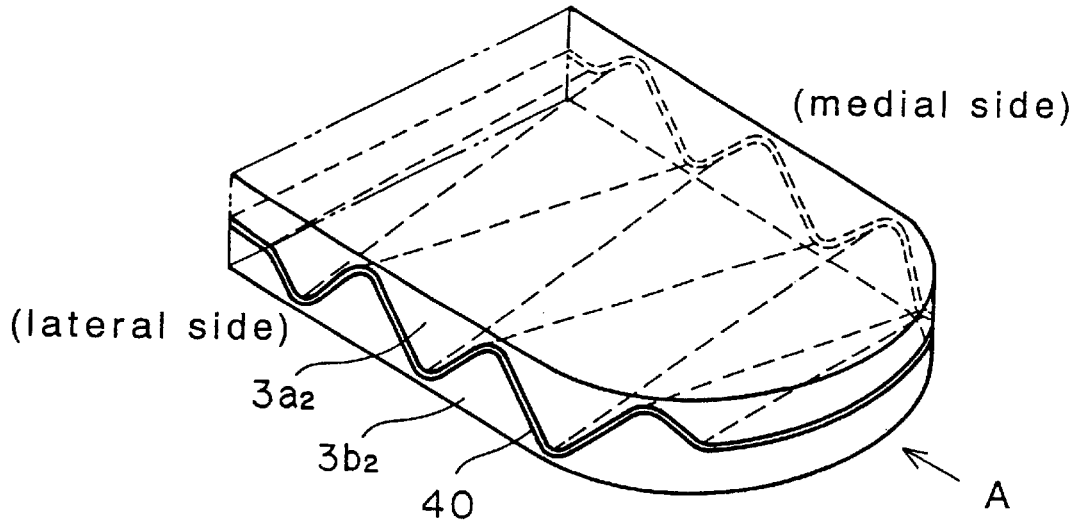
FIG. 6 is an enlarged perspective view of the heel portion of the midsole construction.
Figure 7:
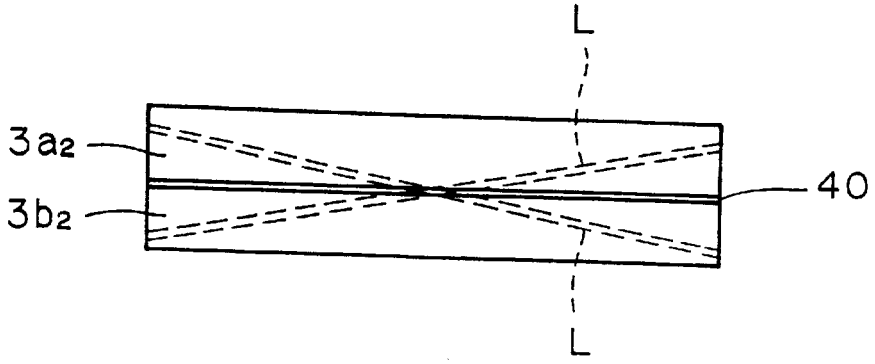
FIG. 7 is an end view of the heel portion shown in FIG. 6, as viewed in the direction A.

Here, the heel portion 40 of the corrugated sheet 4 is shown in detail in FIGS. 6 and 7. As shown in these figures, the phase of the wave configuration of the heel portion 40 of the corrugated sheet 4 is offset by one-half pitch between the medial and lateral sides.

That is, as regards the wave configuration of the heel medial side to the heel lateral side, the crest at the heel medial side is positioned against the trough at the heel lateral side. Similarly, the trough at the heel medial side is positioned against the crest at the heel lateral side.

Thus, the ridge line of the wave configuration at the heel medial side gradually declines as it goes toward the heel central portion, and when the ridge line crosses the heel central portion, the amplitude of the wave configuration becomes zero. As the ridge line goes over the heel central portion, it becomes a trough line, and the trough line declines as it goes toward the heel lateral side.

Similarly, the ridge line of the wave configuration at the heel lateral side gradually declines as it goes toward the heel central portion, and when the ridge line crosses the heel central portion, the amplitude of the wave configuration becomes zero. As the ridge line goes over the heel central portion, it becomes a trough line, and the trough line declines as it goes toward the heel medial side.

In this way, because the amplitude of the wave configuration is zero at the central portion between the heel medial and lateral sides, flexibility of the midsole is maintained at the heel central portion and the cushioning properties can be further improved. Moreover, the compressive hardness of the midsole is made greater at the heel medial and lateral sides each of which has a larger amplitude, and transverse deformation after landing can be prevented at the heel medial and lateral sides, thereby improving the running stability. In such a fashion, two contradictory requirements of prevention of transverse deformation and securement of cushioning properties on landing are satisfied at the heel portion.

In addition, a dotted line L in FIG. 7 indicates the line that connects the crest portions of the wave configuration at the medial and lateral sides of the heel portion 40 with the corresponding trough portions, which is positioned against the above crest portions, of the wave configuration at the medial and lateral sides of the heel portion 40.

Figure 8:
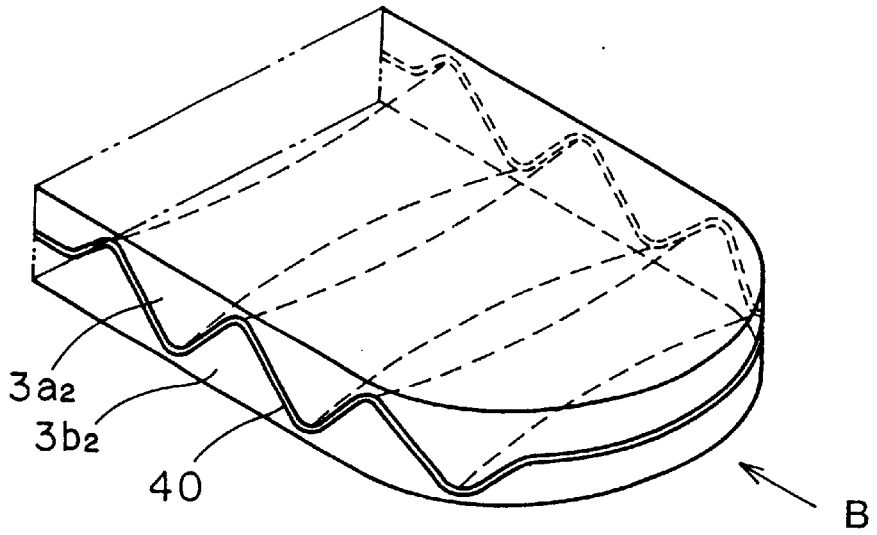
FIG. 8 is an enlarged perspective view of the heel portion of the midsole construction.
Figure 9:
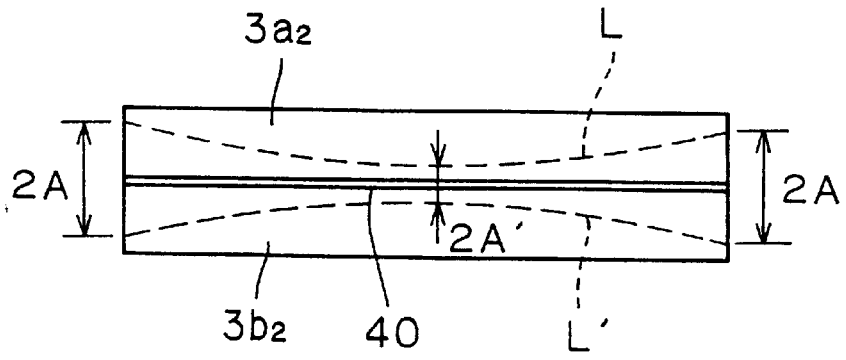
FIG. 9 is an end view of the heel portion shown in FIG. 8, as viewed in the direction B.

The heel portion 40 of the corrugated sheet 4 is not limited to the embodiment shown in FIGS. 6, 7 and the embodiment shown in FIGS. 8, 9 can also be employed. In FIGS. 8 and 9, the amplitude of the wave configuration of the heel portion 40 is larger on the medial and lateral sides of the heel portion 40, and smaller at the heel central portion.

That is, the following relation exists between the amplitudes A and A'.

$$2A>2A' \text{ or } A>A'$$

A: amplitude on the heel medial and lateral sides of the wave configuration of the corrugated sheet;

A': amplitude at the heel central portion of the wave configuration of the corrugated sheet.

Thus, similarly to the example shown in FIGS. 6 and 7, flexibility of the midsole is maintained at the heel central portion and cushioning properties can be further improved. The compressive hardness of the midsole is made greater on the medial and lateral sides, and as a result, lateral or transverse deformation of the heel portion after landing can be prevented and running stability can be improved.

Figure 10:
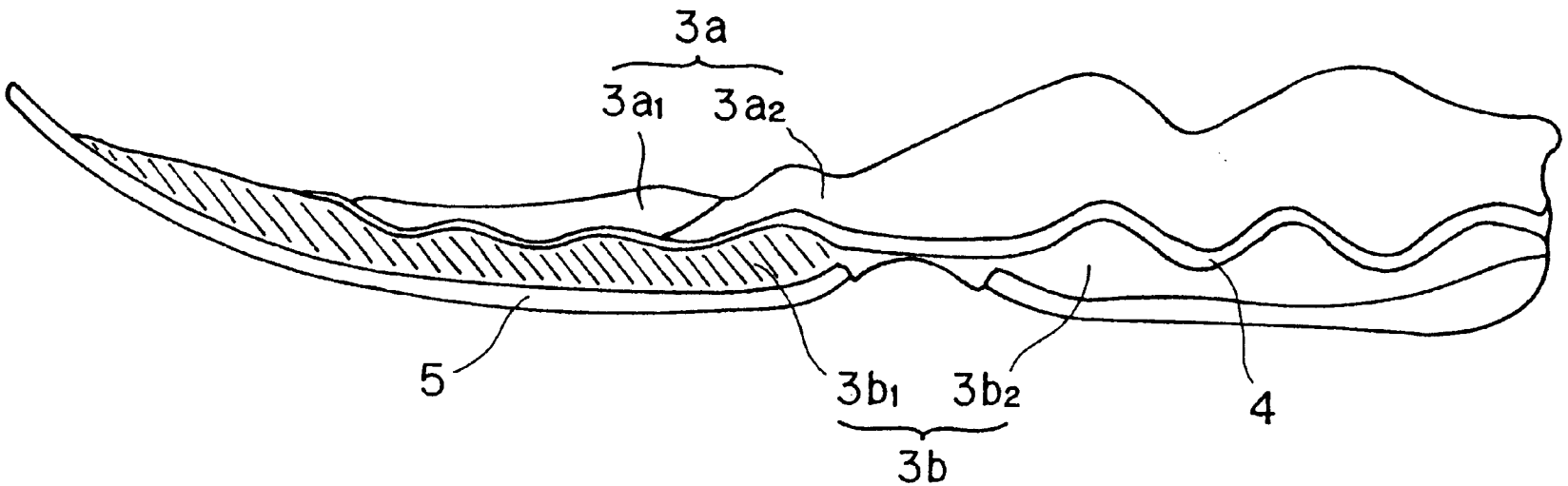
FIG. 10 is a side view of the midsole construction according to a second embodiment of the present invention.

FIG. 10 shows another embodiment of the present invention. In FIG. 10, hardness of the lower forefoot portion $3b_1$ (see the hatching portion) of the lower midsole 3*b* is lower than that of the upper forefoot portion $3a_1$ of the upper midsole 3*a*. Thus, at the time of landing, shock load from the contact surface with the ground to the forefoot portion is relieved and dispersed at the lower forefoot portion $3b_1$.

On the other hand, in that the upper forefoot portion $3a_1$ is relatively hard to be deformed, the corrugated sheet 4 develops a resistant force against the force applied from the foot sole of an athlete to the upper forefoot portion $3a_1$, and thus, the forefoot portion can be prevented from being deformed in the lateral direction. The athletic shoes shown in this second embodiment are suitable for tennis or basketball where players move relatively more often in the lateral direction.

Hardness of the upper forefoot portion 3*a,* of the upper midsole 3*a* is preferably 40–70 degrees at C scale of Asker hardness. Hardness of the lower forefoot portion $3b_1$ of the lower midsole 3*b* is preferably 30–60 degrees at C scale of Asker hardness. And difference of hardness between the upper forefoot portion $3a_1$ the lower forefoot portion $3b_1$ is preferably about 10 degrees at C scale of Asker hardness.

In a preferred embodiment, hardness of the upper forefoot portion $3a_1$ of the upper midsole 3*a* is set at about 55 degrees and hardness of the lower forefoot portion $3b_1$ of the lower midsole 3*b* is set at about 45 degrees. On the other hand, when synthetic resin having comparatively rich elasticity is used as a corrugated sheet 4, hardness of the corrugated sheet 4 is preferably set at 55–60 degrees at D scale of Asker hardness.

The procedure to alter the hardness of the upper forefoot portion $3a_1$ and the lower forefoot portion $3b_1$ is to make the expansion ratios of the upper and lower forefoot portions $3a_1$ and $3b_1$ different by using the same or different material, in the same manner as the first embodiment.

Figure 11:
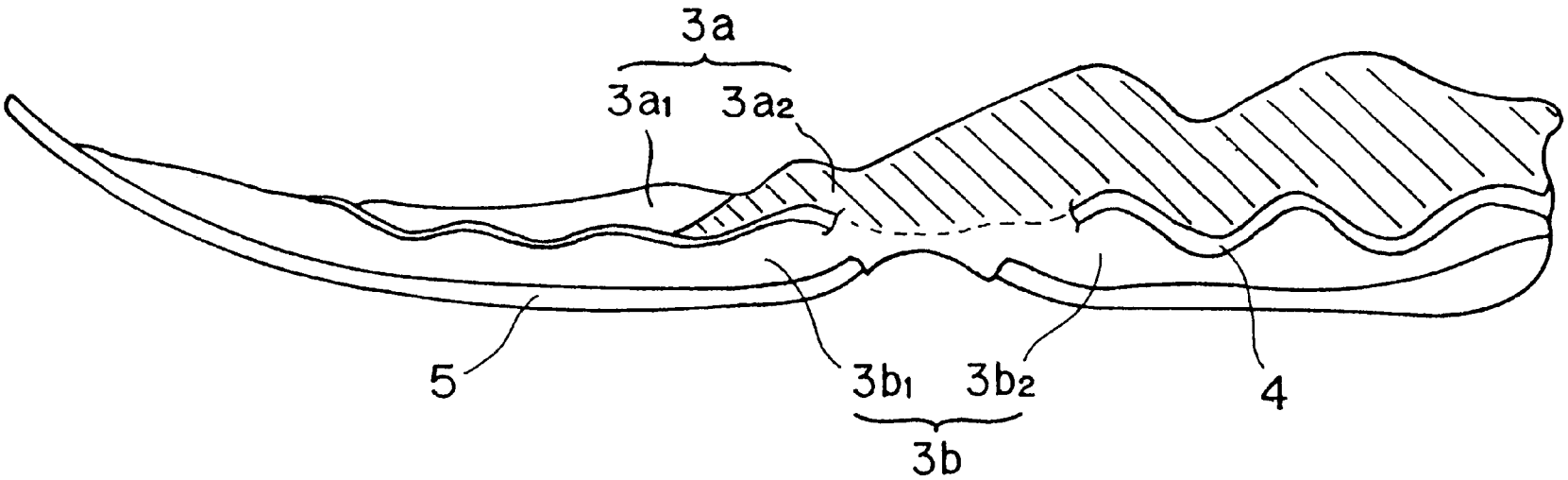
FIG. 11 is a side view of the midsole construction according to a third embodiment of the present invention.

FIG. 11 shows the third embodiment of the present invention. In FIG. 11, hardness of the upper heel portion $3a_2$ (see the hatching portion) of the upper midsole 3*a* is lower than that of the lower heel portion $3b_2$ of the lower midsole 3*b*. Thus, contact feeling of the heel portion of an athlete on landing can be made pleasant and cushioning properties can be improved. The athletic shoes of this third embodiment are suitable as walking shoes.

In addition, each hardness of the upper heel portion $3a_2$ and lower heel portion $3b_2$ and difference of hardness therebetween are similar to those in the first embodiment. And in altering the expansion ratio, to differentiate the hardness of the upper heel portion $3a_2$ from the hardness of the lower heel portion $3b_2$ is the same measures as in the first embodiment.

Figure 12:
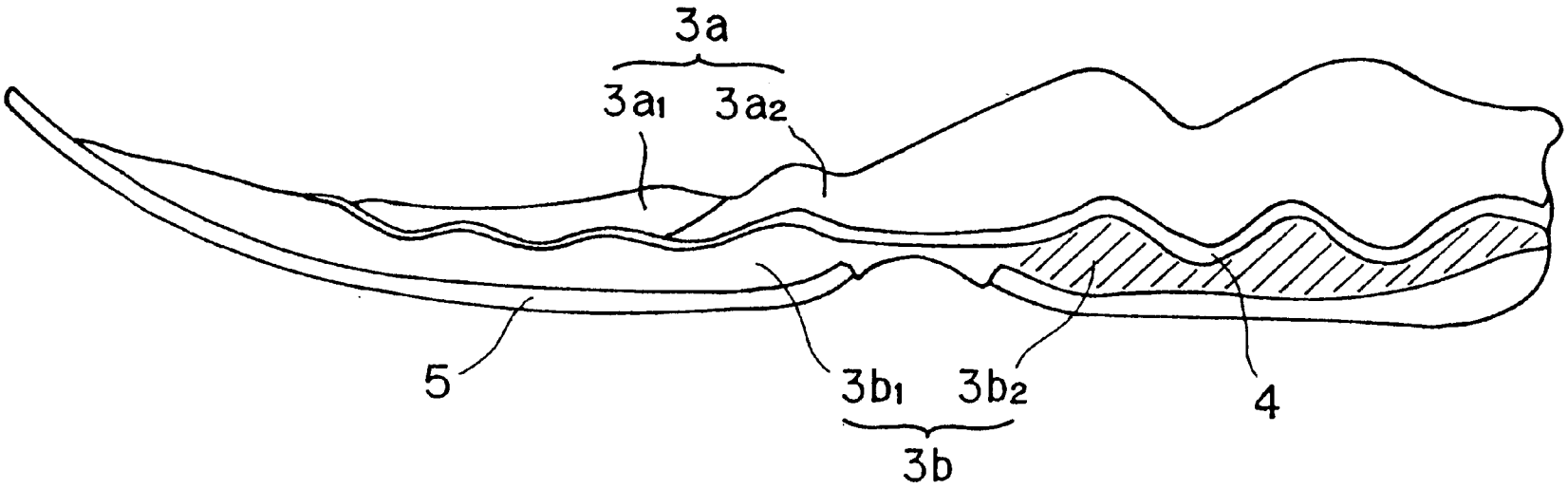
FIG. 12 is a side view of the midsole construction according to a fourth embodiment of the present invention.

FIG. 12 shows the fourth embodiment of the present invention. In FIG. 12, hardness of the lower heel portion $3b_2$ (see the hatching portion) of the lower midsole 3*b* is lower than that of the upper heel portion $3a_2$ of the upper midsole 3*a*. Thus, at the time of landing, shock load from the contact surface with the ground to the heel portion is relieved and dispersed by the lower heel portion $3b_2$, and as a result, cushioning properties of the heel portion can be improved.

On the other hand, in that the upper heel portion $3a_2$, which has a higher hardness than the lower heel portion $3b_2$ is relatively hard to be deformed, the corrugated sheet 4 generates a resistant force against the force applied to the upper heel portion $3a_2$ from the foot sole of an athlete. As a result, lateral deformation of the heel portion on landing can be prevented. The athletic shoes of this fourth embodiment are suitable for tennis or basketball where players move more often in the lateral direction.

Figure 13:
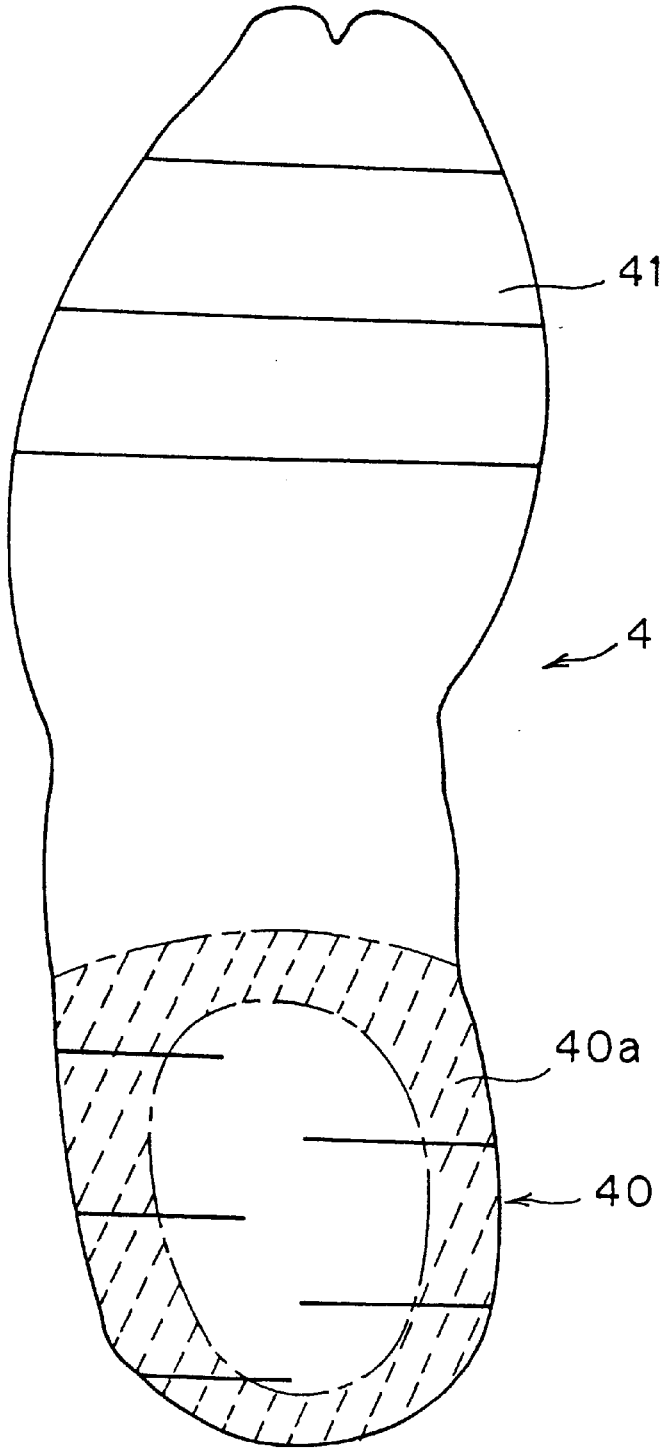
FIG. 13 is a top plan view of a first alternative of the corrugated sheet of the midsole construction.

FIG. 13 shows the first alternative of the corrugated sheet 4. In FIG. 13, a fiber-reinforced plastic (FRP) sheet 40*a* is disposed along the outer circumference of the heel portion 40 of the corrugated sheet 4. This fiber-reinforced plastic sheet 40*a* comprises reinforcement fiber and matrix resin. Reinforcement fiber may be carbon fiber, aramid fiber, glass fiber or the like. Matrix resin may be thermoplastic or thermosetting resin.

Thus, the compressive hardness (hardness to be deformed against the compressive force) of the heel circumferential portion of the midsole 3 is made higher and as a result, even in the athletics where severe lateral movements are involved, lateral deformation of the shoes after landing can be prevented and running stability can be ensured. Moreover, because the heel of a foot can be restrained from unnecessarily sinking into the midsole 3, loss of the athletic power can be lessened.

On the other hand, in the heel central portion, which has a relatively small compressive hardness compared to the heel outer circumferential portion, flexibility of the midsole 3 is maintained in some degree and cushioning properties on landing can be secured at this heel central portion.

Additionally, in this case, when a relatively low elastic material is used as a corrugated sheet 4, the heel central portion of the midsole 3 can be made more flexible and cushioning properties on landing can be advanced.

When hardness of the lower heel portion $3b_2$ is made lower than that of the upper heel portion $3a_2$ (see FIG. 12), with the upper heel portion $3a_2$ less deformed compared to the lower heel portion $3b_2$, lateral deformation of the shoes after landing can be securely prevented and running stability can be further improved.

The fiber-reinforced plastic sheet 40*a* may be bonded to the corrugated sheet 4 or it may be injection molded together with the corrugated sheet 4.

In addition, a metal plate such as SUS (or stainless steel) plate, super elastic alloy plate, or the like can be substituted for a fiber-reinforced plastic sheet 40*a*. Moreover, a sheet made of other plastic materials, if they have higher elasticity (or higher modulus of elasticity) than the corrugated sheet 4, can be employed.

Figure 14:
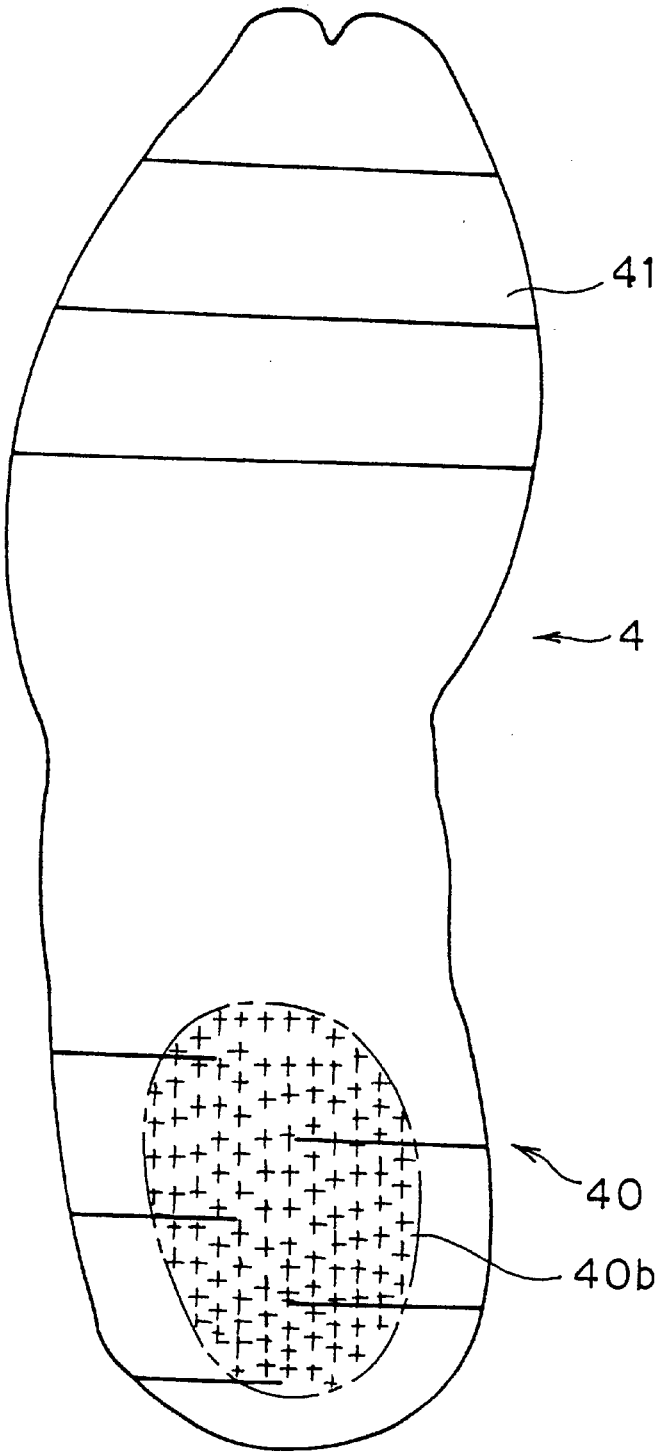
FIG. 14 is a top plan view of a second alternative of the corrugated sheet of the midsole construction.

FIG. 14 shows the second alternative of the corrugated sheet of the present invention. In FIG. 14, multiple holes are formed in the center of the heel portion 40 of the corrugated sheet 4 and the heel central portion is meshed.

This meshed portion 40*b* decreases the compressive hardness of the heel central portion of the midsole 3, and thus, flexibility of the midsole 3 is maintained and cushioning properties on landing can be improved.

On the other hand, in that compressive hardness of the midsole 3 is relatively high at the heel outer circumferential portion, transverse deformation after landing can be prevented and running stability can be ensured.

In this case, when hardness of the lower heel portion $3b_2$ is made lower than that of the upper heel portion $3a_2$ (see FIG. 12), with the cushioning properties of the lower heel portion $3b_2$, cushioning properties of the heel portion can be further improved.

In addition, the shape of a hole formed in the heel portion of the corrugated sheet 4 is not limited to circle, rectangle or slit and may be any other kind.

Also, as a meshed portion 40*b,* instead of forming multiple holes directly in the heel central portion of the corrugated sheet 4, a meshed sheet that is formed in a separate process may be injection molded together with the corrugated sheet 4. Moreover, a meshed portion 40*b* may be formed using a lower elastic member (i.e. member having lower modulus of elasticity) than the corrugated sheet 4.

Figure 15:
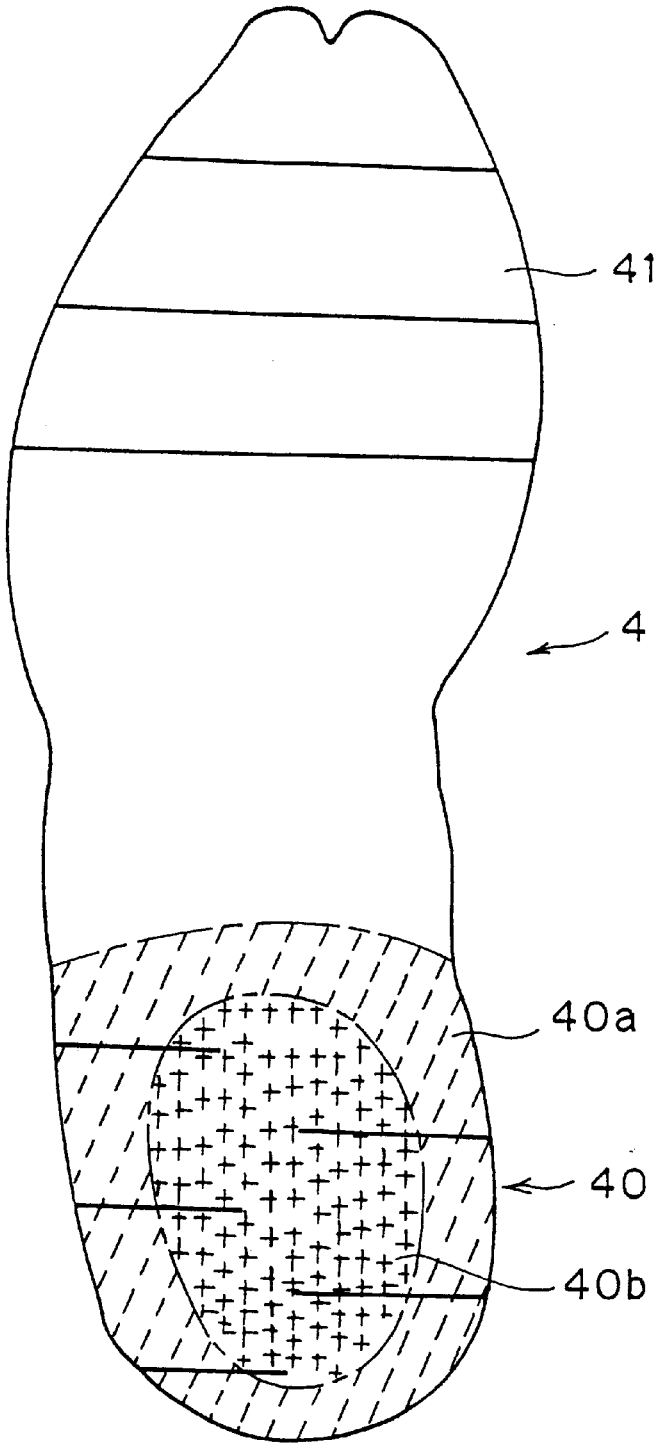
FIG. 15 is a top plan view of a third alternative of the corrugated sheet of the midsole construction.

FIG. 15 indicates the third alternative of the corrugated sheet of the present invention. In FIG. 15, a fiber-reinforced plastic sheet 40*a* is disposed along the outer circumference of the heel portion 40, and multiple holes are formed in the center of the heel portion 40 of the corrugated sheet 4 and the heel central portion is meshed.

By employing the sheet 40*a* and meshed portion 40*b,* lateral deformation on landing can be prevented at the heel outer circumferential portion having a higher compressive hardness, and cushioning properties on landing can be secured at the heel central portion having a lower compressive hardness.

Figure 16:
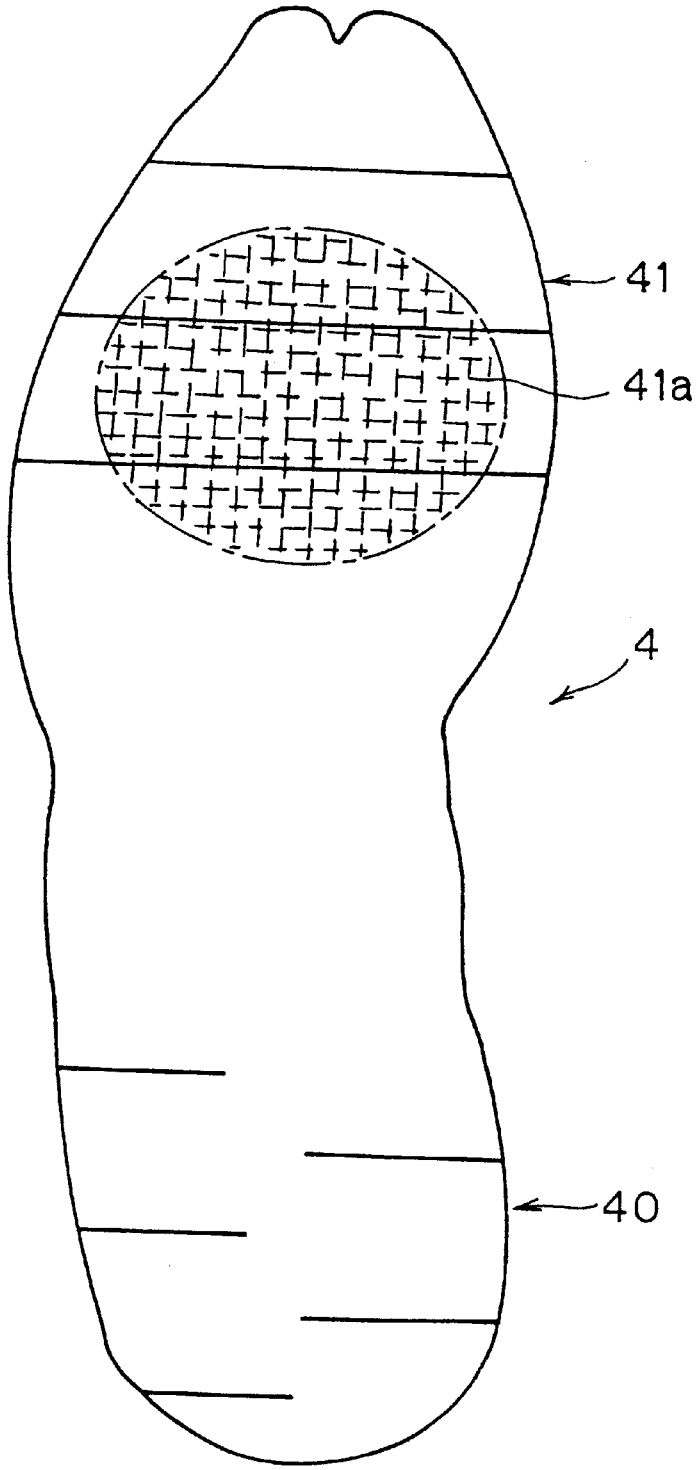
FIG. 16 is a top plan view of a fourth alternative of the corrugated sheet of the midsole construction.

FIG. 16 depicts the fourth alternative of the corrugated sheet of the present invention. In FIG. 16, multiple holes are formed in the central region of the forefoot portion 41 of the corrugated sheet 4 and the forefoot central portion is meshed.

By forming this meshed portion 41*a,* cushioning properties on landing can be ensured at the heel central portion, and the forefoot portion 41 having a decreased compressive hardness increases its flexibility and turnability.

In this case, when the hardness of the upper forefoot portion $3a_1$ of the upper midsole 3*a* is made lower than that of the lower forefoot portion $3b_1$ of the lower midsole 3*b* (see FIG. 2), turnability of the forefoot portion can be further advanced.

Additionally, the shape of a hole formed in the forefoot portion 41 is not limited to circle, rectangle or slit and it may be any other kind.

Furthermore, as a meshed portion 41*a,* instead of forming multiple holes in the forefoot central portion of the corrugated sheet 4, a meshed sheet formed in the other process may be injection molded together with the corrugated sheet 4. Or a meshed portion 41*a* may be formed using a lower elastic material than the corrugated sheet 4.

Figure 17:
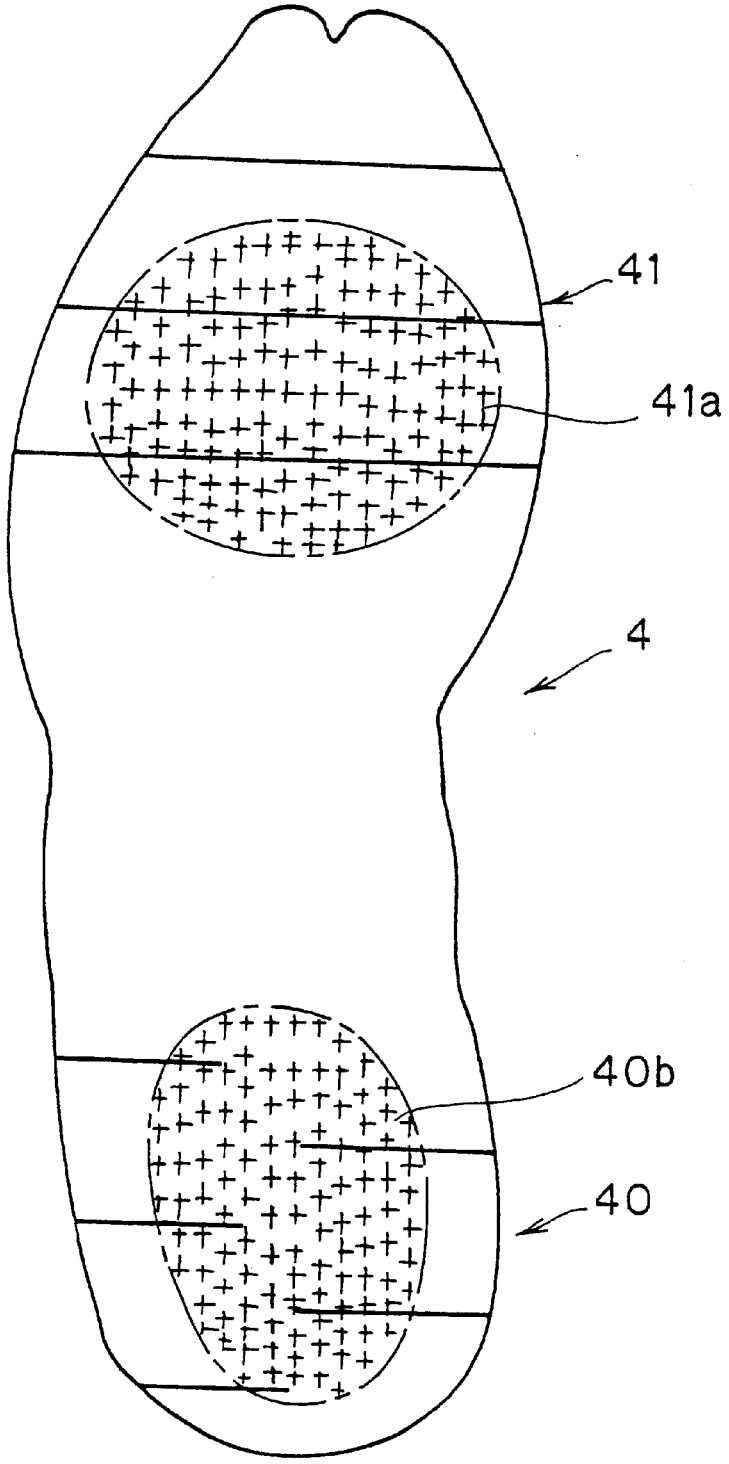
FIG. 17 is a top plan view of a fifth alternative of the corrugated sheet of the midsole construction.

FIG. 17 shows the fifth alternative of the corrugated sheet 4. Here, multiple holes, which are similar to the above second alternative, are formed in the heel central portion of the corrugated sheet 4 and multiple holes, which are similar to the above fourth alternative, are formed in the forefoot central portion of the corrugated sheet 4. That is, the central regions of the heel portion 40 and the forefoot portion 41 are meshed.

By forming these meshed portions 41*a* and 40*b,* cushioning properties on landing are ensured at the heel central portion, and flexibility and turnability of the forefoot portion can be advanced.

In this case, when the hardness of the upper forefoot portion $3a_1$ of the upper midsole 3*a* is made lower than that of the lower forefoot portion $3b_1$ of the lower midsole 3*b* (see FIG. 2), turnability of the forefoot portion can be further improved. In addition, when the hardness of the lower heel portion $3b_2$ of the lower midsole 3*b* is lower than that of the upper heel portion $3a_2$ of the upper midsole 3*a* (see FIG. 12), cushioning properties of the heel portion can be further improved with the cushioning properties of the lower heel portion $3b_2$ and the turning direction can be easily controlled.

In the sixth alternative, a meshed portion 41*a* is formed in the center of the forefoot portion 41 of the corrugated sheet 4 (see FIGS. 16 and 17) and a plurality of grooves (not shown) that extend in the lateral direction are formed in the meshed portion 41*a*. By forming these grooves, flexibility of the forefoot portion of the midsole 3 can be further advanced.

That is, when the distances of the grooves are made different between the medial and lateral sides of the forefoot portion, the grooves can be placed in a fan shape. Thus, weight transfer path (or load path) on the shoe sole surface can nearly conform to the director line of the grooves.

In this way, with the cushioning properties and running stability maintained at the time of landing, the heel portion flexibly deforms according to the weight transfer, and thus, smooth weight transfer and secure grip properties can be ensured.

Figure 18:
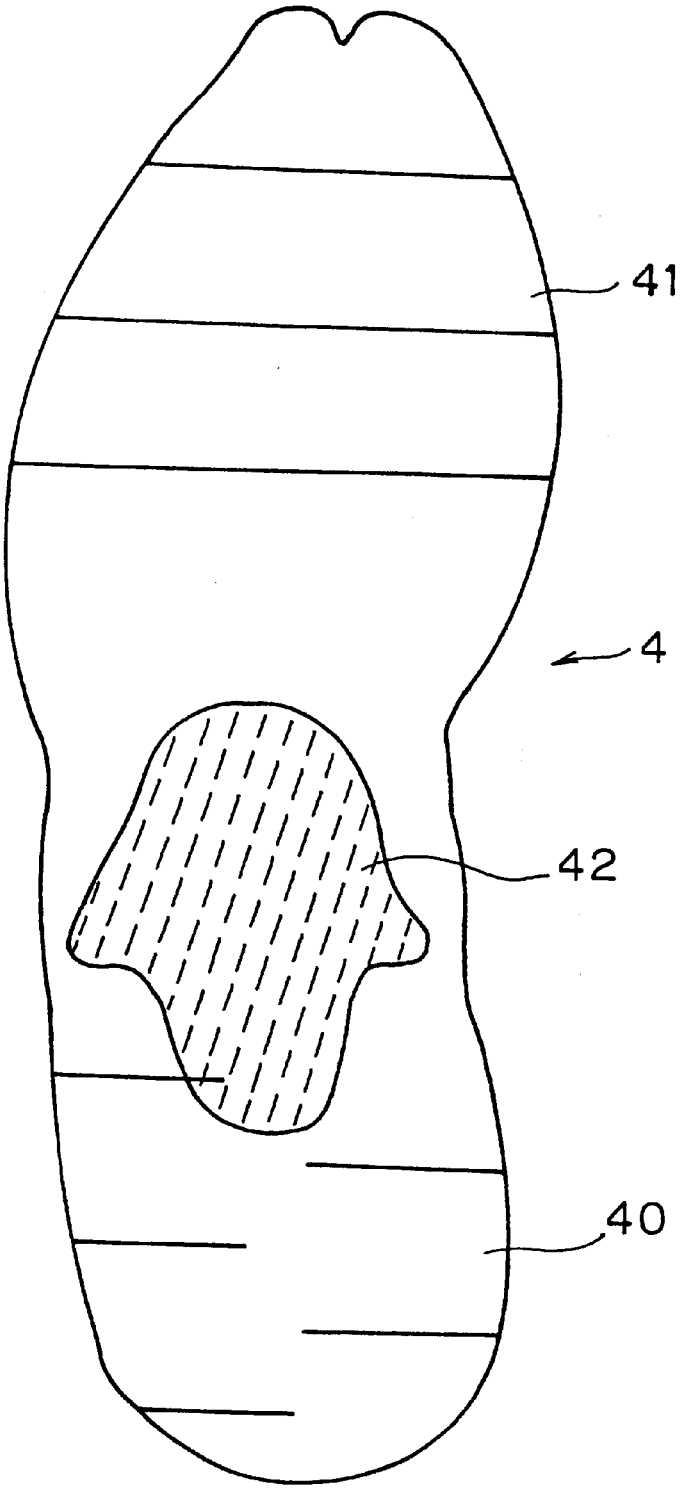
FIG. 18 is a top plan view of a seventh alternative of the corrugated sheet of the midsole construction.

FIG. 18 shows the seventh alternative of the corrugated sheet. In FIG. 18, a fiber-reinforced plastic sheet 42 is provided on the plantar arch portion of the corrugated sheet 4.

By this sheet 42, so-called shank effect can be developed and the rigidity of the plantar arch portion can be improved.

The fiber-reinforced plastic sheet 42 may be bonded to the corrugated sheet 4, or it may be injection molded together with the corrugated sheet 4.

Alternatively, a metal plate such as SUS plate or super elastic alloy plate may be employed. Moreover, a sheet made of other plastic materials can be adopted if it has a higher elasticity than the corrugated sheet 4.

Those skilled in the art to which the invention pertains may make modifications and other embodiments employing the principles of this invention without departing from its spirit or essential characteristics particularly upon considering the foregoing teachings. The described embodiments and examples are to be considered in all respects only as illustrative and not restrictive. The scope of the invention is, therefore, indicated by the appended claims rather than by the foregoing description. Consequently, while the invention has been described with reference to particular embodiments and examples, modifications of structure, sequence, materials and the like would be apparent to those skilled in the art, yet still fall within the scope of the invention.

What is claimed is:

1. A midsole assembly for an athletic shoe comprising:

a midsole including an upper midsole that includes an upper midsole forefoot portion and an upper midsole heel portion, and a lower midsole that is arranged below said upper midsole and that includes a lower midsole forefoot portion and a lower midsole heel portion, wherein each of said portions is respectively made of a respective soft elastic material; and a corrugated sheet that is made of a plastic resin, is disposed in said midsole between said upper midsole forefoot portion and said lower midsole forefoot portion and between said upper midsole heel portion and said lower midsole heel portion, and has an upper corrugated surface surfacially joined to said upper midsole forefoot portion and said upper midsole heel portion and a lower corrugated surface surfacially joined to said lower midsole forefoot portion and said lower midsole heel portion;

wherein said corrugated sheet has a wave configuration including wave crests and wave troughs respectively opposite each other on said upper corrugated surface and said lower corrugated surface;

wherein at least one of said upper midsole forefoot portion and said upper midsole heel portion of said upper midsole has a first upper midsole hardness, at least one of said lower midsole forefoot portion and said lower midsole heel portion of said lower midsole has a first lower midsole hardness, and said first upper midsole hardness is different from said first lower midsole hardness; and wherein said corrugated sheet is harder than all of said portions of said midsole.

2. The midsole assembly according to claim 1, wherein said respective soft elastic material of each one of said portions of said midsole is the same material for all of said portions.

3. The midsole assembly according to claim 1, wherein said respective soft elastic material of each of said upper midsole forefoot portion and said upper midsole heel portion is different from said respective soft elastic material of each of said lower midsole forefoot portion and said lower midsole heel portion.

4. The midsole assembly according to claim 1, wherein said upper midsole heel portion has said first upper midsole hardness, said lower midsole heel portion has said first lower midsole hardness, and said first upper midsole hardness is less than said first lower midsole hardness.

5. The midsole assembly according to claim 4, wherein said upper midsole forefoot portion has a second upper midsole hardness, said lower midsole forefoot portion has a second lower midsole hardness, and said second upper midsole hardness is less than said second lower midsole hardness.

6. The midsole assembly according to claim 4, wherein said upper midsole forefoot portion has a second upper midsole hardness, said lower midsole forefoot portion has a second lower midsole hardness, and said second upper midsole hardness is greater than said second lower midsole hardness.

7. The midsole assembly according to claim 1, wherein said upper midsole heel portion has said first upper midsole hardness, said lower midsole heel portion has said first lower midsole hardness, and said first upper midsole hardness is greater than said first lower midsole hardness.

8. The midsole assembly according to claim 7, wherein said upper midsole forefoot portion has a second upper midsole hardness, said lower midsole forefoot portion has a second lower midsole hardness, and said second upper midsole hardness is less than said second lower midsole hardness.

9. The midsole assembly according to claim 7, wherein said upper midsole forefoot portion has a second upper midsole hardness, said lower midsole forefoot portion has a second lower midsole hardness, and said second upper midsole hardness is greater than said second lower midsole hardness.

10. The midsole assembly according to claim 1, wherein said upper midsole forefoot portion has said first upper midsole hardness, said lower midsole forefoot portion has said first lower midsole hardness, and said first upper midsole hardness is less than said first lower midsole hardness.

11. The midsole assembly according to claim 1, wherein said upper midsole forefoot portion has said first upper midsole hardness, said lower midsole forefoot portion has said first lower midsole hardness, and said first upper midsole hardness is greater than said first lower midsole hardness.

12. The midsole assembly according to claim 1, wherein both said upper midsole forefoot portion and said upper midsole heel portion have said first upper midsole hardness, both said lower midsole forefoot portion and said lower midsole heel portion have said first lower midsole hardness, and said first upper midsole hardness is greater than said first lower midsole hardness.

13. The midsole assembly according to claim 1, wherein both said upper midsole forefoot portion and said upper midsole heel portion have said first upper midsole hardness, both said lower midsole forefoot portion and said lower midsole heel portion have said first lower midsole hardness, and said first upper midsole hardness is less than said first lower midsole hardness.

14. The midsole assembly according to claim 1, wherein a difference between said first upper midsole hardness and said first lower midsole hardness is equal to about 10 points on an Asker C hardness scale.

15. The midsole assembly according to claim 1, wherein one of said first upper midsole hardness and said first lower midsole hardness is in a range from 30 to 60 on an Asker C hardness scale, and the other of said first upper midsole hardness and said first lower midsole hardness is in a range from 40 to 70 on said Asker C hardness scale.

16. The midsole assembly according to claim 15, wherein the entirety of said corrugated sheet has a uniform corrugated sheet hardness in a range from 55 to 60 on an Asker D hardness scale.

17. The midsole assembly according to claim 16, wherein said one of said first upper midsole hardness and said first lower midsole hardness is 45 on said Asker C hardness scale, and said other of said first upper midsole hardness and said first lower midsole hardness is 55 on said Asker C hardness scale.

18. The midsole assembly according to claim 1, wherein the entirety of said corrugated sheet has a uniform corrugated sheet hardness in a range from 55 to 60 on an Asker D hardness scale.

* * * * *